US005761842A

United States Patent [19]

Mäntymaa

[11] Patent Number: 5,761,842

[45] Date of Patent: Jun. 9, 1998

[54] HANDGUN SUPPORT

[76] Inventor: Timo Teijo Tapio Mäntymaa, Tolonkaari 8 A 11, Forssa, Finland

[21] Appl. No.: 649,730

[22] PCT Filed: Dec. 1, 1994

[86] PCT No.: PCT/FI94/00544

§ 371 Date: May 29, 1996

§ 102(e) Date: May 29, 1996

[87] PCT Pub. No.: WO95/15474

PCT Pub. Date: Jun. 8, 1995

[30] Foreign Application Priority Data

Dec. 1, 1993 [FI] Finland ..... 935387

[51] Int. Cl.[6] ..... F41C 23/10; F41C 23/12; F41C 23/14; F41C 23/04

[52] U.S. Cl. ..... 42/71.02; 42/73; 42/72

[58] Field of Search ..... 42/71.02, 72, 73, 42/71.01

[56] References Cited

U.S. PATENT DOCUMENTS

| | | | |
|---|---|---|---|
| 202,946 | 4/1878 | Johnson | 42/72 |
| 593,890 | 11/1897 | Houston | 42/72 |
| 914,675 | 3/1909 | Renfors | 42/72 |
| 961,511 | 6/1910 | Marble | 42/73 |
| 1,027,556 | 5/1912 | Marshall . | |
| 1,877,016 | 9/1932 | Munson | 42/72 |
| 2,400,349 | 5/1946 | Haberstump | 42/72 |
| 2,441,487 | 5/1948 | Howard | 42/72 |
| 2,462,091 | 2/1949 | Garand | 42/72 |
| 3,162,966 | 12/1964 | LaCoss | 42/72 |
| 3,184,877 | 5/1965 | Andrews | 42/72 |
| 3,648,396 | 3/1972 | Smith | 42/72 |
| 4,271,623 | 6/1981 | Beretta | 42/72 |
| 4,660,311 | 4/1987 | Breitfeld et al. | 42/72 |
| 4,735,007 | 4/1988 | Gal | 42/72 |
| 5,209,215 | 5/1993 | Morrison | 42/73 |

FOREIGN PATENT DOCUMENTS

| | | | |
|---|---|---|---|
| 150704 | 4/1937 | Austria | 42/72 |
| 999680 | 2/1952 | France | 42/73 |
| 2535038 | 4/1984 | France | 42/72 |
| 1065756 | 9/1959 | Germany | 42/72 |
| 3130562 | 2/1983 | Germany | 42/73 |
| 404036 | 5/1943 | Italy | 42/72 |
| 628732 | 9/1949 | United Kingdom | 42/72 |

*Primary Examiner*—Stephen M. Johnson

*Attorney, Agent, or Firm*—Andrus, Sceales, Starke & Sawall

[57] ABSTRACT

The invention relates to a wrist support for a handgun. According to the invention, a support (1, 2, 3) is attached to a grip projecting from the bottom portion of the grip substantially away from the gun in the direction of the barrel (44), so that the support (1, 2, 3) settles in the part between the hand holding the gun and the armpit or at least at some point of the lower part of the arm.

8 Claims, 5 Drawing Sheets

FIG. 8
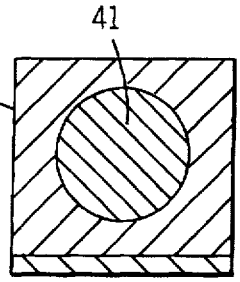
FIG. 10
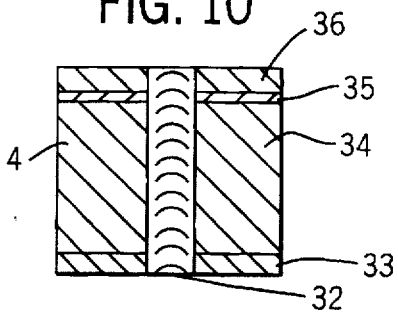
FIG. 9
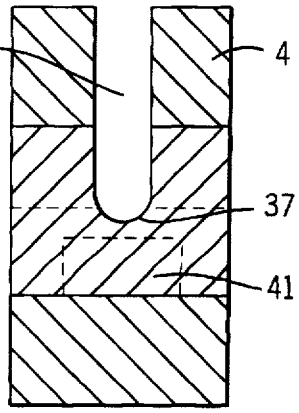
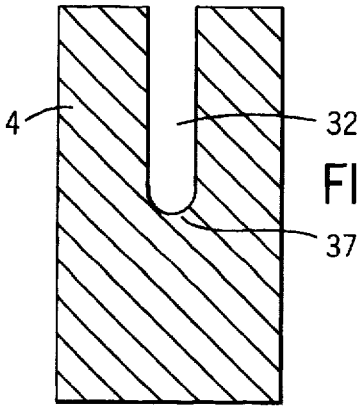
FIG. 11
FIG. 12
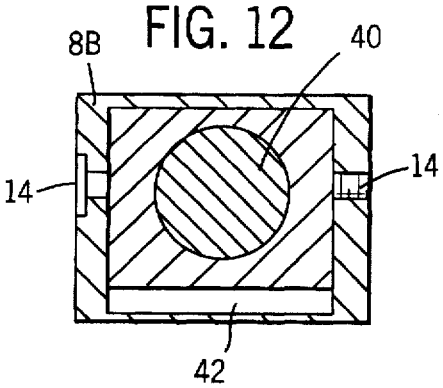
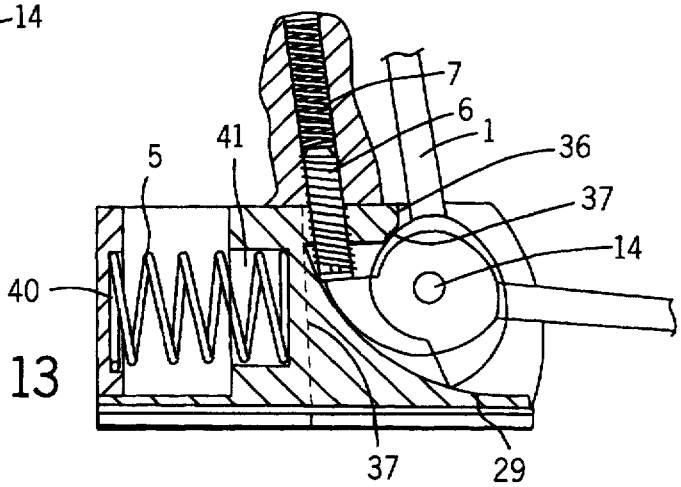
FIG. 13

HANDGUN SUPPORT

BACKGROUND OF THE INVENTION

When fired, the recoil forces the gun backwards and the barrel upwards. To compensate for the force that moves the barrel upwards, several different types of stocks for handguns have been constructed, or belts to be winded round the arm in order to get the shooting more accurate. A secure and inexpensive support solution, which still maintains the properties of the handgun, has not so far been presented. The objective of the invention is thus to find a simple and cheap support solution, which is easily attached to old firearms or to new firearms already in the production stage.

With the support according to the invention, a decisive improvement of the above mentioned disadvantages is achieved. The invention is characterized in what is presented in the patent claims.

SUMMARY OF THE INVENTION

The invention provides a construction preserving the properties of the handgun. A better accuracy of aiming is achieved. The emptying of the handgun magazine is expedited. The lifting effect of the recoil on the barrel can be compensated. The support of the weapon is divided over more muscles, which means that the gun can be carried in aiming/firing position for a longer time without tiring the arm so quickly. The support of the gun weight is partly moved past the wrist to the whole arm. The trembling of the wrist decreases. The solution according to the invention can be used in handguns of different types and models. In double-acting handguns, in which the firing pin is cocked by pulling the trigger, the disadvantage of the cocking of the pin when aiming is eliminated by the support according to the invention, i.e. the moving of the aiming point due to heavy squeeze is well prevented (service and army pistols). If only one hand is in use, the support of the gun is very beneficial. Moreover, the gun can be used in non-support position despite the support, as the rear front of the slide can be designed to fit properly into the hand. The support can quickly (immediately) be put into non-support and support positions. The support can be mounted into any kind of a handgun. The attachment can easily be adopted to different types of guns, either into the space behind the magazine or with a suitable slot. The angle of the wrist support can be adjusted vertically and/or horizontally to achieve a desired support.

BRIEF DESCRIPTION OF THE DRAWING

The invention is below described with reference to the enclosed drawing, in which FIG. 8 presents a partially cut-way front view of the frame slide, FIG. 9 presents the frame slide from above, FIG. 10 presents a partially cut-away rear view of the frame slide, FIG. 11 presents the frame slide from below, FIG. 12 presents a front view of the guide bushing, FIG. 13 presents a partially cut-away view of the control and locking system of the hand support.

DETAILED DESCRIPTION OF THE PREFERRED EMBODIMENTS

Figure 1:
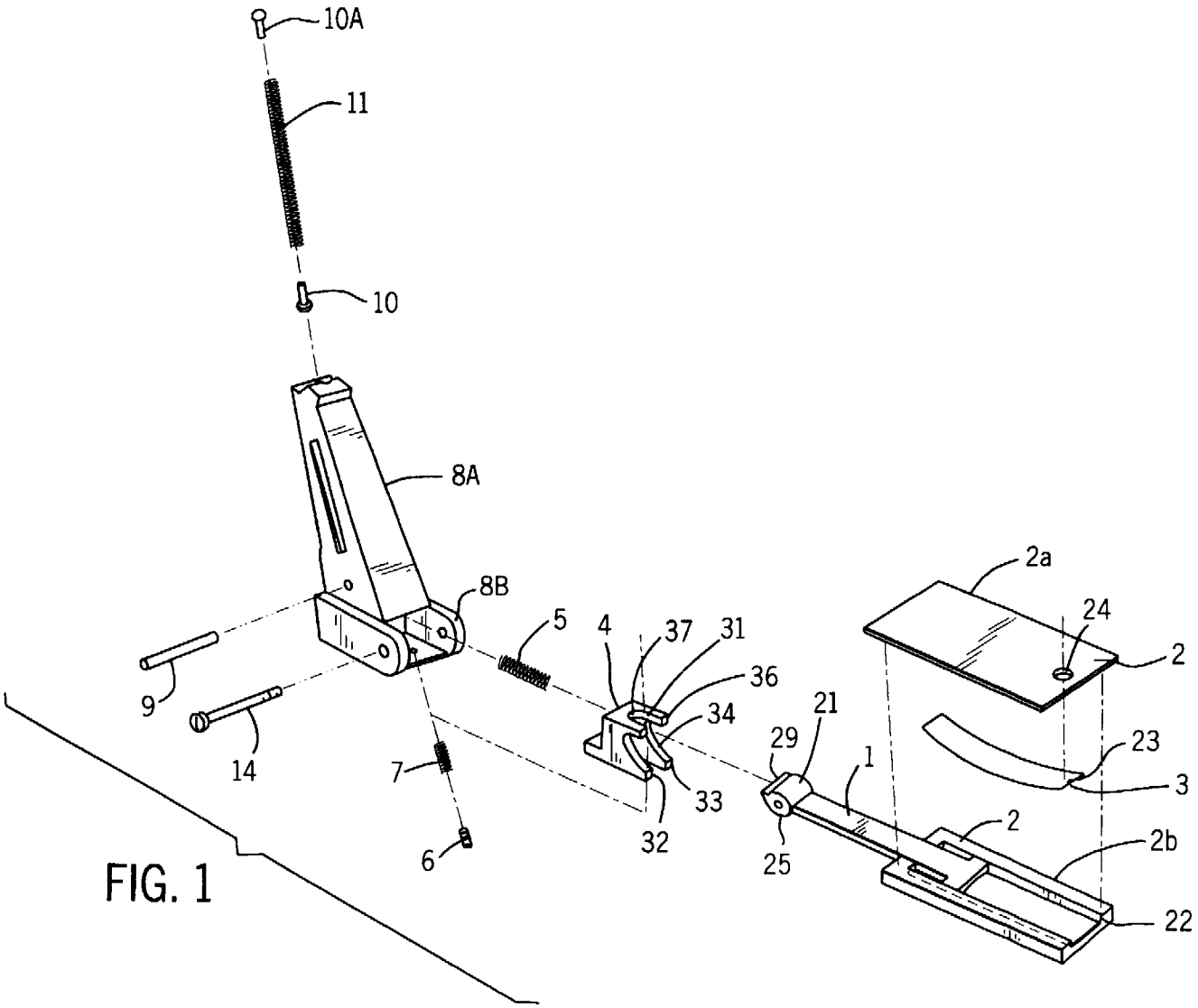
FIG. 1 presents an exploded view of the support arrangement.

FIG. 1 presents one embodiment of the invention, in which a reversible support has been attached to a Colt Government handgun. As shown most clearly in FIG. 6, the handgun consists of e.g. a barrel 44, a cartridge casing, a butt, breech, pin, grip, trigger 45 etc. (all not presented in the pictures) so that the gun can be used for shooting purposes.

The support of the present invention consists of a frame construction 2, comprising two plates 2a-2b, of which at least one has been provided with a longitudinal slot 22 for the sliding of the one end of the inner slide 1 in this slot, when the said plates have been placed against each other. A leaf spring 3 is provided between the plates, which controls the forward and reverse motion of the inner slide and keeps it in a certain position. In the one end of the leaf spring there is a projection 23, which at the assembling has been placed in the hole 24 of the upper plate to keep the spring 3 in position.

The support comprises moreover the inner slide 1, mounted to move in the slot 22 made in the bottom plate 2(*b*), the inner slide being formed in T-shape so that the arms of the T run in the slot, and in the one end of the T-piece in the cross direction of the slide, there is a, preferably e.g. cylinder-shaped, enlargement 21, through which has been formed the hole 25 in the cross direction of the slide. After the cylinder, there is provided to the T-piece a short, from one side straight and from the other side curved, portion 29 which controls the pivot angle of the support by means of the screw 6 and the slide 4, as shown in FIG. 13.

The slide 1 provides that the support can be telescopically adjusted. Through the hole 25 can be placed a pin, a screw or the like 14, which at the same time attaches the slide to the bottom portion of the grip or to individual fixing means 8A and 8B attached to the bottom portion of the grip. This forms the pivot axle 14 of the support, around which the support can be turned at least between two positions, in one of which the support becomes e.g. the rear surface of the grip, and in the other substantially parallel to the barrel direction but in the opposite direction, see FIG. 6. The support can, depending on the model of the handgun, be incorporated with the back portion of the grip or only placed in its bottom portion, when it is preferably extendable, e.g. telescopically.

The support, like the slide arrangement described above, is attached to a notched frame slide 4, which is flexibly attachable, in a space provided by the spring 5, to the guide bushing 8B of the frame slide 4. The guide bushing 8B is then attached to a gun related frame fixing piece 8A, which is attachable to the grip 26 e.g. in the way the grip plates are attached. The angle of the support or the slide can be adjusted vertically in relation to the barrel e.g. by the angle adjuster screw 6 and the arresting spring 7 related thereto as shown most clearly in FIG. 13.

The head 29 of the slide 1 is, in the support position pushed along the gradient plane 34 of the notch of the slide 4. The spring 5 thus forces the slide 4 and the slide 1 against each other. When the slide 1 is turned in upper position, the spring 5 yields so that the slide 4 moves against the gun or forwards, and when the slide 1 is in desired upper position, the spring 5 pushes the slides 1 and 4 against each other, also as shown in FIG. 13.

The frame slide guide bushing 8B and the frame fixing piece 8A are in this case of one piece, by which they are attached to the gun grip e.g. by the frame fixing insert pin 9.

FIG. 1 presents moreover how the pressing plugging-up point 10 of the firing pin spring, counterpart piece 10A of the intermediate pin and the pin spring 11 can be placed.

Figure 2:
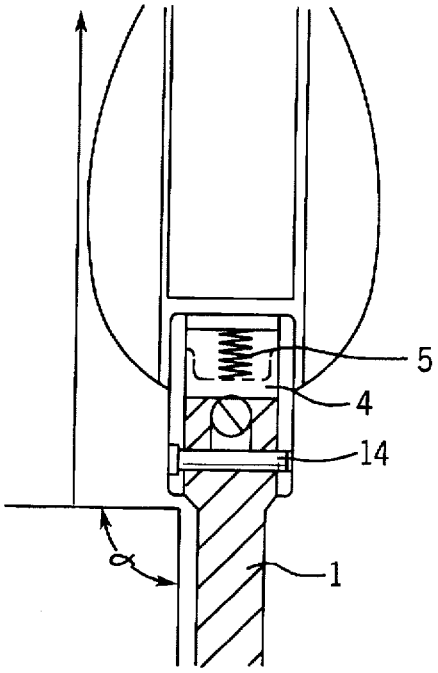
FIG. 2 presents the support from the end of the grip.
Figure 3:
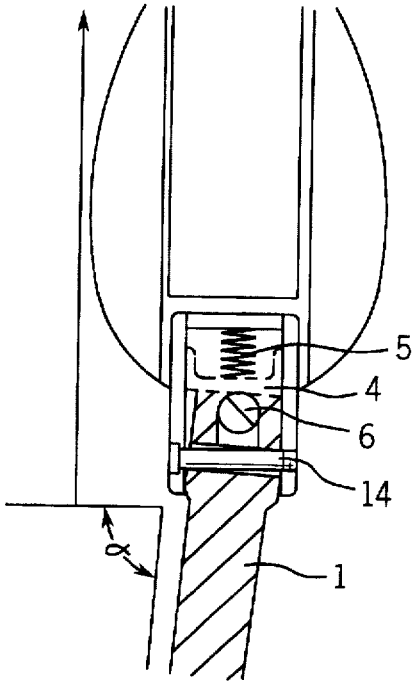
FIG. 3 presents another embodiment of FIG. 2.
Figure 4:
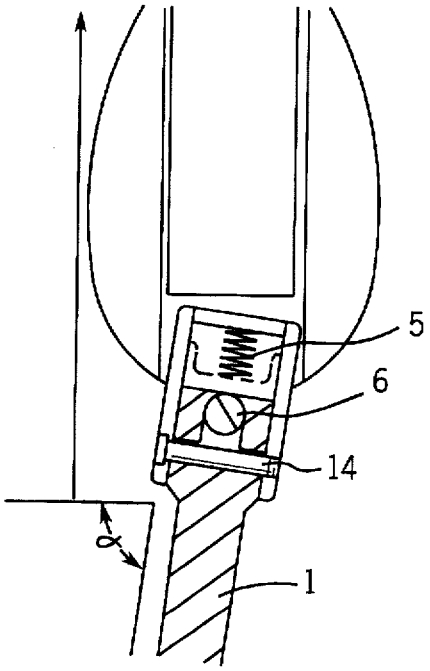
FIG. 4 presents another embodiment of FIG. 2.
Figure 5:
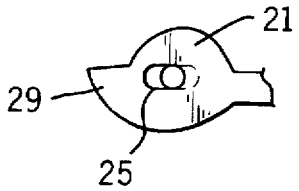
FIG. 5 presents a partial side view of the inner slide and the pivoted axle.

FIGS. 2 and 3 show the support from beneath the grip. In FIG. 2, the support and the slide 1 have been placed substantially in the gun direction, by which the angle $\alpha$ is substantially 90 degrees. In FIG. 3, the angle $\alpha$ of the slide 1 is approx. 84 degrees. This has been materialized by broaching the hole 25 of the screw 14 e.g. into an oval shape, as shown in the partially cut-away FIG. 5. When the edges of frame slide 4 have also been shaped so that one surface of plane 34 against the cam 29 is deeper than the other, the spring 5 pushes the frame slide 4 into an oblique (inclined) position. The connection between the frame slide 4 and bushing 8B has been made wide so that the frame slide 4 can turn or has space for turning sufficiently in the guide bushing 8B for the frame slide 4. Inner slide 1 can thus turn the required angle. Other solutions can also be used, as shown in FIG. 4, where the slide-bushing arrangement has been mounted obliquely from the gun direction, through a desired angle $\alpha$.

Figure 6:
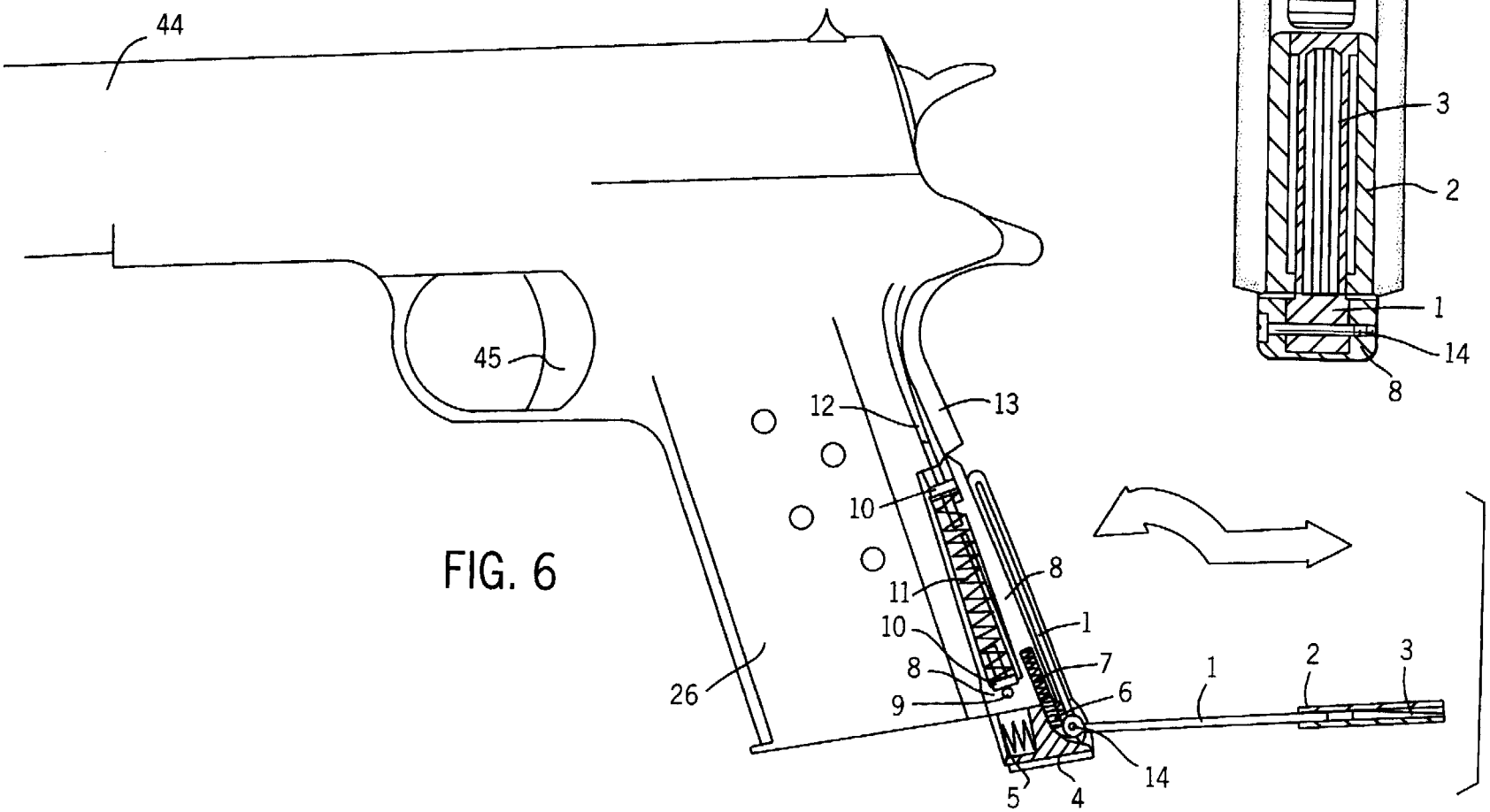
FIG. 6 presents a side view of the support attached to the grip in two positions.

FIG. 6 presents a partially cut-away side view of the gun and the support attached to its grip in two positions, i.e. in non-support and support position. FIG. 6 shows an example how the support can be mounted in the grip. The reference numbers 12 present the intermediate pin of the firing pin and number 13 the grip safety element. The path of the support is shown in FIG. 6 by an arrow. The function of the spring 3 is illustrated. The leaf spring 3 keeps the support in position in different lengths of location. In this case the outer surface of the frame construction 2 forms the extension of the grip safety element 13 in the non-support position.

Figure 7:
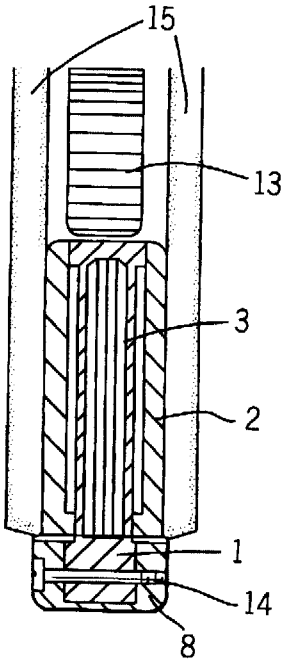
FIG. 7 presents a partially cut-away rear view of the support attached to the grip.

FIG. 7 presents a picture of the support and the rear front of the grip. The grip plates 15 are placed on both sides the grip.

FIGS. 8–11 present the frame slide 4 from different directions. FIG. 8 shows a partially cut-away front view of the frame slide 4. The support of the spring 5 on the slide surface is illustrated by number 41, which is a slot for the head of the spring 5. FIG. 9 presents the frame slide 4 from above. The slot 31 gives room for the tightening of the screw 6 and the movement of the inner slide 1 between the nonsupport and support positions. FIG. 10 gives a partially cutaway rear view of the frame slide. The frame slide 4 comprises e.g. a bottom portion 33, curved nortlon 34, an oblique surface 35 and an upper portion 36. The upper and bottom portions 33, 36 are provided with U-shaped slots 31 and 32, the bottom of which is depicted by number 37. FIG. 11 shows the frame slide from beneath. The slots 31 and 32 make the slide 4 fork-shaped from beneath.

FIG. 12 presents a front view of the guide bushing 8B. For the bottom portion 33 of the frame slide 4 there is a gap 42 in the guide bushing to enable the turning of the support 10 between the positions. A cut-out 40 is provided for the spring 5, as in the frame slide 4 the cut-out 41. This is to secure the retention of the spring 5 in the desired positions.

FIG. 13 presents a partially cut-away picture of the hand support control and interlocking system in two positions. FIG. 13 demonstrates by the shape of the head of the support or the inner slide 1 the ability to move the frame slide 4 within the space provided by the spring 5. The screw 6 adjusts the angle of the slide or the support in relation to the gun in the support position. When the spring 5 pushes the inner slide 1, the inner slide stays in desired position. When the slide is turned around the pivoted axle 14, the slide 1 hits the surface of the frame slide 4 from the surface 35 and the curved surface 34. Because the slide 1 is cam-shaped, it also stays in the non-support position, because the spring 5 again pushes the frame slide 4 against the cam 29 of the slide 1. To turn the support and the slide 1 it needs a force, which is sufficiently large that it can push the slide 4 forwards. During the pivoting of the support, the cam 29 slides against the slide surface 34.

Figure 14:
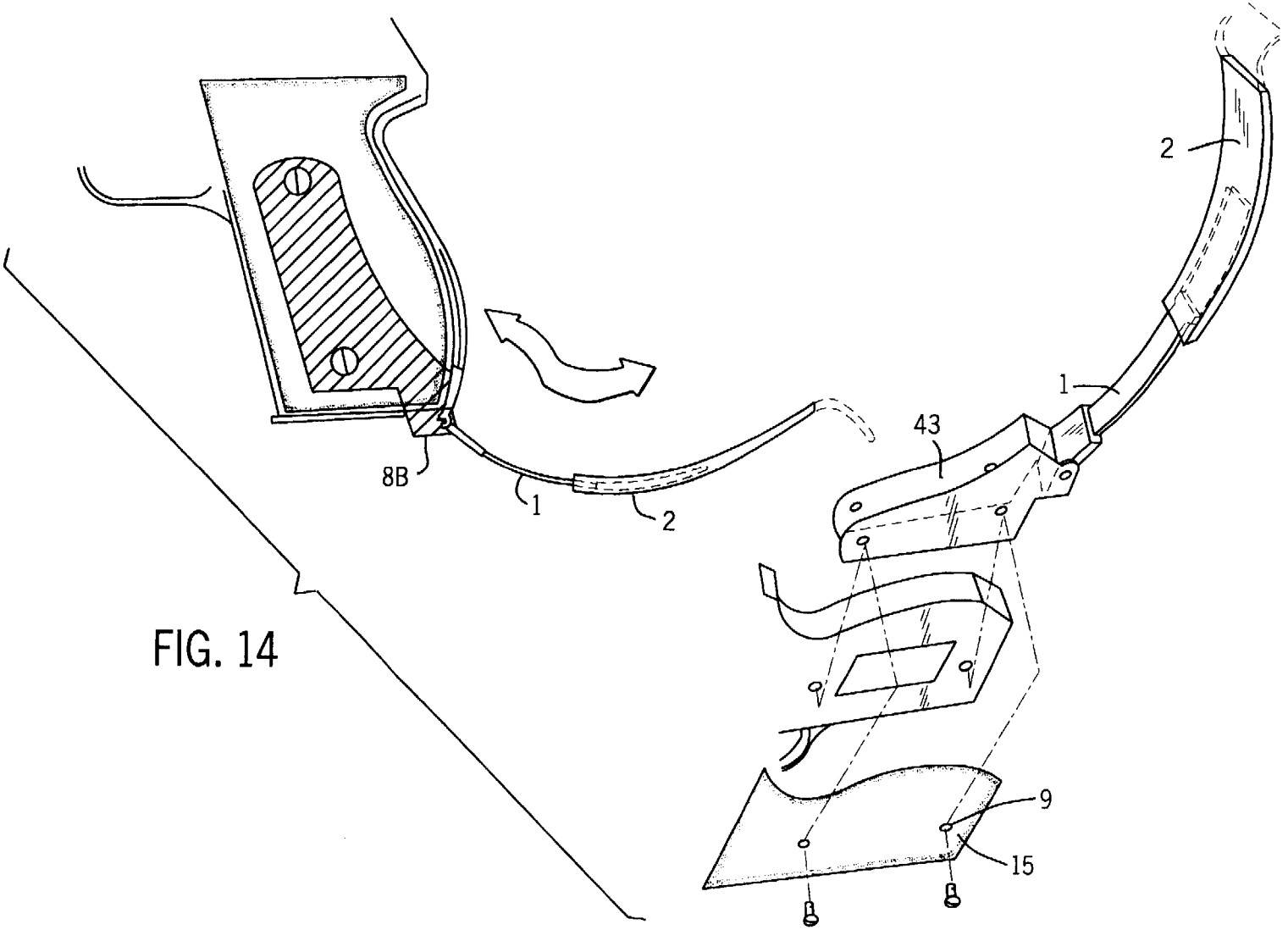
FIG. 14 presents an exploded view of another embodiment of the invention.

FIG. 14 presents an exploded view of another embodiment of the invention. The support, i.e. the inner slide 1, can be attached to the grip by e.g. the frame 43, as in the Colt. The support has then been attached to the back surface of the grip on the whole portion of the grip. The fixing of the frames can be made from the fixing holes and fixing screws of the grip plates. The thick arrow shows the path of the support or the inner slide. In this case can, of course, be used the above mentioned frame slide/guide bushing system which is attached underneath the grip.

The embodiment of the invention can also relate to the method of supporting a handgun, in which the weapon is taken into the hand in firing-position from the grip of the gun. For the support, an elongated support attached to the grip substantially parallel to the direction of the barrel but in the opposite direction, is directed from the bottom part of the grip against at least some point of the lower part of the arm.

Alternative embodiments comprise e.g. detachable or fixed attachments of the support to the grip. The support can e.g. be attached to the grip by a snap-on locking, it can be pushed into the grip if not desired to be kept on the grip. The slide can be telescopically extendable or not. The slot 22 can be cased, e.g. a plastic part, by which the elongated portion of the slide is closed inside the case.

Fixed positions are feasible. Locked constructions, in which the motion of the inner slide is limited by notches, can hamper and slow down the use between different positions. This alternative is, however, not to be excluded from the scope of protection of the invention.

The support is applicable to all handguns with pistol grip, weather their force comes from powder, air, spring or the like. The need for the support increases if some extra equipment is attached to the gun, e.g. telescopic sight, muffler, laser sight. The locking systems of the inner slide can comprise different previously known systems, and the materials used are optional.

The support is generally attached in the support position to support the lower part of the arm from at least one point.

The invention has above been described with reference to one of its embodiments. The invention is not to be considered as so limited but all modifications within the scope of the inventive idea defined by the patent claims are naturally included.

I claim:

1. A handgun support suitable for attachment to a grip of a handgun for supporting the handgun on the arm of a shooter, said grip having a butt at an end thereof, said handgun support comprising:

fixing means (8A) for mounting said handgun support proximate to the butt of the grip of the handgun, said fixing means having a bushing means (8B) for receiving a pivot pin (14);

an inner slide member (1) having a first end with a head (21), said head having a hole (25), said inner slide means being pivotally mounted in said bushing means with said pivot pin (14) extending through said hole;

support means (2) slidably mounted on said inner slide member for movement along said inner slide member between retracted and extended positions; and a frame slide (4) slidably mounted in said bushing means with spring means (5) for biasing said frame slide into engagement with said head of said inner slide member, said frame slide engaging said head of said inner slide member for allowing said inner slide member and support means to move between a first position in which said support member lies along the grip of the handgun and a second position in which said support means extends from the grip of the handgun to contact the arm of the shooter to support the handgun, the engagement of said frame slide with said head of said inner slide member retaining said inner slide member and support means in said first and second positions.

2. A handgun support according to claim 1 wherein said frame slide (4) includes an adjustment screw (6) for limiting the movement of said inner slide member and support means with respect to said frame slide for establishing said first position of said inner slide member and support means.

3. A handgun support according to claim 1 wherein the handgun has a barrel and wherein at least one of said frame slide and said head of said inner slide member are formed to position said inner slide member and said support means at an angle to the barrel.

4. A handgun support according to claim 3 wherein said hole (25) of said inner slide member head (21) is enlarged to position said inner slide member and support means at an angle to the barrel.

5. The handgun support according to claim 3 wherein said bushing means and said frame slide are mounted at an angle with respect to the barrel.

6. A handgun support according to claim 1 wherein said fixing means is formed for detachably mounting said handgun support to the grip of the handgun.

7. A handgun support according to claim 1 wherein said fixing means is formed for fixedly mounting said handgun support to the grip of the handgun.

8. The handgun support according to claim 1 wherein said support means includes means for retaining said support means (2) in position on said inner slide member (3).

* * * * *